US010684051B2

(12) United States Patent
Toyoshima

(10) Patent No.: US 10,684,051 B2
(45) Date of Patent: Jun. 16, 2020

(54) REFRIGERATION CYCLE APPARATUS DETERMINING REFRIGERANT CONDENSER AMOUNT

(71) Applicant: Mitsubishi Electric Corporation, Tokyo (JP)

(72) Inventor: Masaki Toyoshima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/553,233

(22) PCT Filed: Apr. 23, 2015

(86) PCT No.: PCT/JP2015/062418
§ 371 (c)(1),
(2) Date: Aug. 24, 2017

(87) PCT Pub. No.: WO2016/170650
PCT Pub. Date: Oct. 27, 2016

(65) Prior Publication Data

US 2018/0038621 A1 Feb. 8, 2018

(51) Int. Cl.
*F25B 49/02* (2006.01)

(52) U.S. Cl.
CPC ..... *F25B 49/02* (2013.01); *F25B 2500/19* (2013.01); *F25B 2500/23* (2013.01);
(Continued)

(58) Field of Classification Search
CPC ..... F25B 2500/19; F25B 2500/23; F25B 2500/24; F25B 2700/193;
(Continued)

(56) References Cited

U.S. PATENT DOCUMENTS 7,000,415 B2 * 2/2006 Daddis, Jr. ..... A47F 3/0408 165/110
8,806,877 B2 * 8/2014 Tamaki ..... F25B 45/00 62/149
(Continued)

FOREIGN PATENT DOCUMENTS

CN 102378884 A 3/2012
EP 1 970 651 A1 9/2008
(Continued)

OTHER PUBLICATIONS

Extended EP Search Report dated Sep. 20, 2018 issued in corresponding EP patent application No. 15889889.0.
(Continued)

*Primary Examiner* — Edward F Landrum
*Assistant Examiner* — Chang H Park
(74) *Attorney, Agent, or Firm* — Posz Law Group, PLC

(57) ABSTRACT

A refrigeration cycle apparatus includes a refrigerant circuit that includes a condenser, multiple temperature sensors that are disposed in line in a direction in which refrigerant flows in the condenser and detect refrigerant temperature of the condenser, a memory unit that stores positional information of the multiple temperature sensors, and a refrigerant amount calculation unit that calculates a refrigerant amount of the condenser based on the positional information of the multiple temperature sensors, detected temperatures of the multiple temperature sensors and a saturated liquid temperature of the refrigerant.

14 Claims, 7 Drawing Sheets

(52) U.S. Cl.
CPC ... *F25B 2500/24* (2013.01); *F25B 2700/1931* (2013.01); *F25B 2700/21162* (2013.01); *F25B 2700/21163* (2013.01)

(58) Field of Classification Search
CPC ..... F25B 2700/1931; F25B 2700/195; F25B 2700/2116; F25B 2700/21162; F25B 2700/21163; F25B 49/02; F25B 2700/21161
See application file for complete search history.

(56) References Cited

U.S. PATENT DOCUMENTS

| | | | | |
|---|---|---|---|---|
| 2009/0019879 | A1 * | 1/2009 | Kasahara ..... | F25B 9/008 62/335 |
| 2011/0308267 | A1 | 12/2011 | Tamaki et al. | |

FOREIGN PATENT DOCUMENTS

| | | | | |
|---|---|---|---|---|
| JP | 07260264 | A | * | 10/1995 |
| JP | H07-260264 | A | | 10/1995 |
| JP | 3207962 | B2 | | 9/2001 |
| JP | 4975052 | B2 | | 7/2012 |
| WO | 2008/035418 | A1 | | 3/2008 |

OTHER PUBLICATIONS

International Search Report of the International Searching Authority dated Jun. 30, 2015 for the corresponding international application No. PCT/JP2015/062418 (and English translation).
Office Action dated Jul. 4, 2019 issued in corresponding CN patent application No. 201580078805.0 (and English translation).

* cited by examiner

REFRIGERATION CYCLE APPARATUS DETERMINING REFRIGERANT CONDENSER AMOUNT

CROSS REFERENCE TO RELATED APPLICATION

This application is a U.S. national stage application of International Application No. PCT/JP2015/062418, filed on Apr. 23, 2015, the contents of which are incorporated herein by reference.

TECHNICAL FIELD

The present invention relates to a refrigeration cycle apparatus, and specifically, relates to a refrigeration cycle apparatus having a function of calculating a refrigerant amount in a refrigerant circuit.

BACKGROUND

In a conventional refrigeration cycle apparatus, when a period of use is extended in a state where clamping of connecting portions of pipes or others is insufficient, refrigerant leakage occurs little by little from a gap in clamped pipes or others in some cases. Moreover, due to damage or the like of pipes, sometimes the refrigerant leakage unexpectedly occurs. Such refrigerant leakage causes a decline in air-conditioning ability or damage to constituting equipment. Moreover, when the refrigerant circuit is excessively filled with refrigerant, pressure transfer of liquid refrigerant is performed for an extended period in a compressor, and thereby failure is caused.

Therefore, from the viewpoint of improving the quality and the maintenance easiness, it is desired that a function of calculating a refrigerant amount charged in the refrigerant circuit to determine excess or shortage of the refrigerant amount is to be provided. In Patent Literature 1, there is suggested a method of measuring operation state amounts at multiple positions in a refrigerant circuit, calculating a refrigerant amount from the measured operation state amounts and comparing thereof with an appropriate refrigerant amount to determine excess or shortage of refrigerant amount.

PATENT LITERATURE

Patent Literature 1: Japanese Patent No. 4975052

To improve calculation accuracy of the refrigerant amount, it is necessary to improve estimation accuracy of the refrigerant amount in a condenser in which an existing amount of refrigerant is large. Here, in the method suggested in Patent Literature 1, a volumetric proportion of each of a liquid phase, a two-phase gas-liquid and a gas phase in a heat exchanger is indirectly obtained from a heat exchange amount, and thereby the refrigerant amount is calculated. In this case, since there is a need to regulate errors due to installation environment of an actual device or the like, calculation is performed by using coefficients or assuming conditions. Therefore, these become error causes and make it difficult to obtain sufficient accuracy in calculation of the refrigerant amount.

SUMMARY

The present invention has been made to solve the above problem, and has an object to provide a refrigeration cycle apparatus capable of improving calculation accuracy of a refrigerant amount.

A refrigeration cycle apparatus according to one embodiment of the present invention includes a refrigerant circuit that includes a condenser; multiple temperature sensors that are disposed in line in a direction in which refrigerant flows in the condenser and detect refrigerant temperature of the condense, a memory unit that stores positional information of the multiple temperature sensors, and a refrigerant amount calculation unit that calculates a refrigerant amount of the condenser based on the positional information of the multiple temperature sensors, detected temperatures of the multiple temperature sensors and a saturated liquid temperature of the refrigerant.

According to a refrigeration cycle apparatus related to one embodiment of the present invention, by calculating a refrigerant amount from positional information and detected temperatures of multiple temperature sensors disposed in a direction in which refrigerant of a condenser flows, this eliminates necessity for error regulation by coefficients, and improves calculation accuracy of the refrigerant amount.

DETAILED DESCRIPTION

Hereinafter, embodiments of the refrigeration cycle apparatus in the present invention will be described in detail with reference to the drawings.

Embodiment 1

Figure 1:
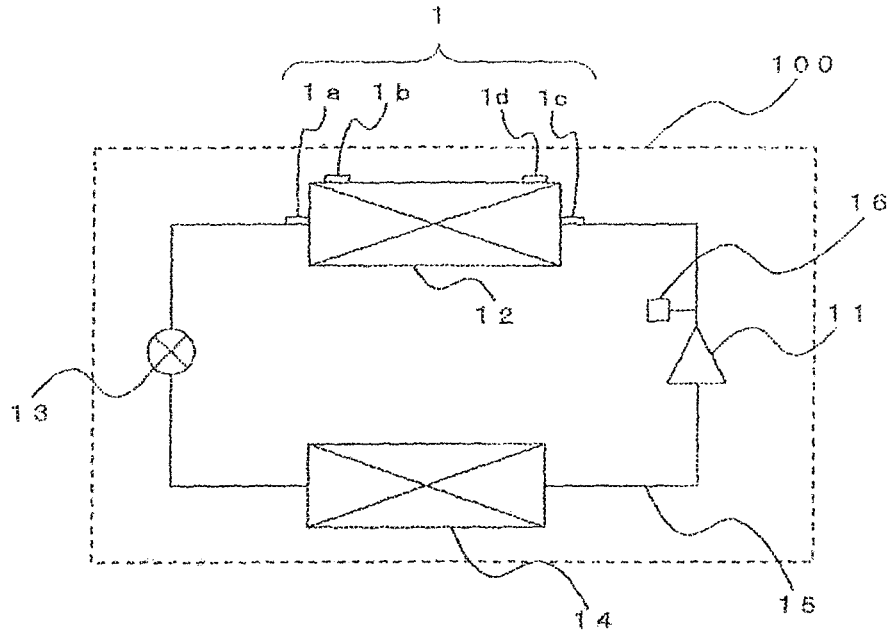
FIG. 1 is a diagram showing a refrigerant circuit configuration of a refrigeration cycle apparatus in Embodiment 1 of the present invention.

FIG. 1 is a diagram showing a refrigerant circuit configuration of a refrigeration cycle apparatus 100 in Embodiment 1 of the present invention. The refrigeration cycle apparatus 100 of this embodiment is utilized as an air-conditioning apparatus used for indoor cooling by performing vapor compression refrigeration cycle operations. As shown in FIG. 1, the refrigeration cycle apparatus 100 includes a refrigerant circuit configured with a compressor 11, a condenser 12, a pressure-reducing device 13 and a evaporator 14 connected by a connection pipe 15. The refrigeration cycle apparatus 100 further includes a controller 20 (FIG. 2) that controls the refrigerant circuit.

The compressor 11 is configured with, for example, an inverter compressor or other devices capable of performing capacity control, and sucks in gas refrigerant and discharges thereof upon compressing and bringing into a state of high temperature and pressure. The condenser 12 is, for example, a fin-and-tube heat exchanger of a cross-fin type configured with a heat transfer pipe and many fins. The condenser 12 causes the refrigerant of high temperature and pressure discharged from the compressor 11 to exchange heat with air to condense thereof. The pressure-reducing device 13 is configured with, for example, an expansion valve or a capillary tube, and reduces the pressure of the refrigerant condensed by the condenser 12 to expand thereof. Similar to the condenser 12, the evaporator 14 is, for example, a fin-and-tube heat exchanger of a cross-fin type configured with a heat transfer pipe and many fins. The evaporator 14 allows the refrigerant expanded by the pressure-reducing device 13 to exchange heat with air to evaporate thereof.

On a discharge side of the compressor 11, a discharge pressure sensor 16 that detects the discharge pressure of the refrigerant in the compressor 11 is provided. Moreover, temperature sensors 1 for detecting temperature of refrigerant flowing through the condenser 12 are provided to the condenser 12. The temperature sensors 1 includes: a first liquid-phase temperature sensor 1*a* disposed at an outlet of the condenser 12; a second liquid-phase temperature sensor 1*b* disposed upstream of the first liquid-phase temperature sensor 1*a*; a first gas-phase temperature sensor 1*c* disposed at an inlet of the condenser 12; and a second gas-phase temperature sensor 1*d* disposed downstream of the first gas-phase temperature sensor 1*c*. The temperature sensors 1 are disposed in line along a direction in which the refrigerant flows in the condenser 12. The information detected by the discharge pressure sensor 16 and the temperature sensors 1 is output to the controller 20.

Figure 2:
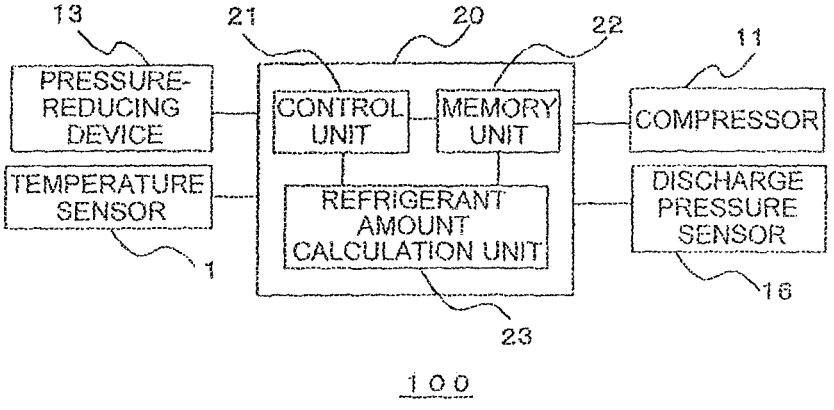
FIG. 2 is a diagram showing a control configuration of the refrigeration cycle apparatus in Embodiment 1 of the present invention.

FIG. 2 is a diagram showing a control configuration of the refrigeration cycle apparatus in 100. The controller 20 controls each unit of the refrigeration cycle apparatus 100 and is configured with a microcomputer, a DSP (Digital Signal Processor) or the like. The controller 20 includes a control unit 21, a memory unit 22 and a refrigerant amount calculation unit 23. The control unit 21 and the refrigerant amount calculation unit 23 are a functional block implemented by executing programs or an electronic circuit, such as an ASIC (Application Specific IC). The control unit 21 controls the rotation speed of the compressor 11, the opening degree of the pressure-reducing device 13 and so forth, to control operations of the entire refrigeration cycle apparatus 100. The memory unit 22 is configured with a non-volatile memory or the like, to store various kinds of programs and data used for controlling by the control unit 21. The memory unit 22 stores, for example, specifications of each unit, information related to physical properties of the refrigerant flowing through the refrigerant circuit, positional information of the temperature sensors 1, and other pieces of information. The refrigerant amount calculation unit 23 calculates a refrigerant amount in the refrigerant circuit of the refrigeration cycle apparatus 100 based on the information output from the discharge pressure sensor 16 and the temperature sensors 1.

Next, operations of the refrigeration cycle apparatus 100 will be described. In the refrigeration cycle apparatus 100, refrigerant in a form of low temperature and pressure gas is compressed by the compressor 11, to be a gas refrigerant of high temperature and pressure and discharged. The gas refrigerant of high temperature and pressure discharged from the compressor 11 flows into the condenser 12. The refrigerant of high temperature and pressure flowed into the condenser 12 radiates heat to outdoor air or the like, and is condensed to be a liquid refrigerant of high pressure. The liquid refrigerant of high pressure flowed from the condenser 12 flows into the pressure-reducing device 13, and is expanded and depressurized to become a two-phase gas-liquid refrigerant of low temperature and pressure. The two-phase gas-liquid refrigerant flowed from the pressure-reducing device 13 flows into the evaporator 14. The two-phase gas-liquid refrigerant flowed into the evaporator 14 exchanges heat with air or water to evaporate, to thereby become a gas refrigerant of low temperature and pressure. The gas refrigerant flowed from the evaporator 14 is sucked into the compressor 11 to be compressed again.

Note that the refrigerant usable for the refrigeration cycle apparatus 100 includes single refrigerant, near-azeotropic refrigerant mixture, zeotropic refrigerant mixture and so forth. The near-azeotropic refrigerant mixture includes R410A and R404A, which are HFC refrigerant, and so forth. Other than properties similar to those of zeotropic refrigerant mixture, the near-azeotropic refrigerant mixture has a property of operating pressure about 1.6 times the operating pressure of R22. The zeotropic refrigerant mixture includes R4070 and R1123+R32, which are HFC (hydrofluorocarbon) refrigerant, and so forth. Since the zeotropic refrigerant mixture is a refrigerant mixture having different boiling points, provided with a property of different composition ratio between the liquid-phase refrigerant and the gas-phase refrigerant.

Next, calculation of a refrigerant amount in the refrigerant amount calculation unit 23 will be described. The refrigerant amount Mr [kg] in the refrigeration cycle apparatus 100 is, as shown in Expression (1), expressed as a sum total of products of an internal cubic volume V [$m^3$] and an average refrigeration cycle apparatus density ρ [$kg/m^3$] of each factor.

[Expression 1]

$$M_r = \Sigma V \times \rho \tag{1}$$

Here, in general, most of the refrigerant stays in the condenser 12 having a high internal cubic volume V and an average refrigerant density p. Therefore, in this embodiment, calculation of the refrigerant amount of the condenser 12 in the refrigerant amount calculation unit 23 will be described. Note that a factor having a high average refrigerant density ρ described here refers to a factor of high pressure or a factor with which refrigerant of two-phase gas-liquid or liquid phase passes. The refrigerant amount $M_{r,c}$[kg] of the condenser 12 is expressed by the following expression.

[Expression 2]

$$M_{r,c} = V_c \times \rho_c \tag{2}$$

Since being device specifications, the internal cubic volume Vc [$m^3$] of the condenser 12 is already known. The average refrigerant density ρc [kg/m$^3$] of the condenser 12 is shown by the following expression.

[Expression 3]

$$\rho_0 = R_{cg} \times \rho_{cg} + R_{cs} \times \rho_{cs} + R_{cf} \times \rho_{cf} \quad (3)$$

Here, Rcg [−], Rcs [−] and Rcl [−] represent volumetric proportions of the gas phase, the two-phase gas-liquid and the liquid phase in the condenser 12, respectively, and ρcg [kg/m$^3$], ρcs [kg/m$^3$] and ρcl[kg/m$^3$] represent average refrigerant densities of the gas phase, the two-phase gas-liquid and the liquid phase, respectively. In other words, to calculate the average refrigerant density in the condenser 12, it is necessary to calculate a volumetric proportion and an average refrigerant density of each phase.

First, a calculation method of the average refrigerant density in each phase will be described. The gas-phase average refrigerant density ρcg in the condenser 12 is obtained by, for example, an average value of an inlet density ρd [kg/m$^3$] of the condenser 12 and a saturated vapor density ρcsg [kg/m$^3$] in the condenser 12.

[Expression 4]

$$\rho_{cg} = \frac{\rho_d + \rho_{csg}}{2} \quad (4)$$

The inlet density ρd of the condenser 12 can be calculated from the inlet temperature of the condenser 12 (the detected temperature of the first gas-phase temperature sensor 1*c*) and the pressure (the detected pressure of the discharge pressure sensor 16). Moreover, the saturated vapor density ρcsg in the condenser 12 can be calculated from a condensing pressure (the detected pressure of the discharge pressure sensor 16). Moreover, the liquid-phase average refrigerant density ρcl in the condenser 12 is obtained by, for example, an average value of an outlet density ρsco [kg/m$^3$] of the condenser 12 and a saturated liquid density ρcsl [kg/m$^3$] in the condenser 12.

[Expression 5]

$$\rho_{cl} = \frac{\rho_{sco} + \rho_{csl}}{2} \quad (5)$$

The outlet density ρsco of the condenser 12 can be calculated from the outlet temperature of the condenser 12 (the detected temperature of the first liquid-phase temperature sensor 1*a*) and the pressure (the detected pressure of the discharge pressure sensor 16). Moreover, the saturated liquid density ρcsl in the condenser 12 can be calculated from the condensing pressure (the detected pressure of the discharge pressure sensor 16).

Assuming that the heat flux is constant in the two-phase gas-liquid part, the two-phase average refrigerant density ρcs in the condenser 12 is expressed by the following expression.

[Expression 6]

$$\rho_{cs} = \int_0^1 [f_{cg} \times \rho_{csg} + (1 - f_{cg}) \times \rho_{csl}] dz \quad (6)$$

Here, z [−] refers to quality of refrigerant and fcg [−] refers to a void content in the condenser 12, and are expressed by the following expression.

[Expression 7]

$$f_{cg} = \frac{1}{1 + \left(\frac{1}{z} - 1\right)\frac{\rho_{csg}}{\rho_{csl}} s} \quad (7)$$

Here, s [−] represents a slip ratio. Up to now, many experimental expressions have been suggested as the calculation expression of the slip ratio s, and the calculation expression of the slip ratio s is expressed as a function of a mass flux Gmr [kg/(m$^2$s)], the condensing pressure (the detected pressure of the discharge pressure sensor 16) and the quality z.

[Expression 8]

$$s = f(G_{mr}, P_d, Z) \quad (8)$$

Since the mass flux Gmr varies in accordance with the operating frequency of the compressor 11, detection of variation in the refrigerant amount Mr with respect to the operating frequency of the compressor 11 by calculating the slip ratio s by the method is conducted. The mass flux Gmr can be obtained from the refrigerant flow rate of the condenser 12. The refrigerant flow rate can be estimated by formulating the properties of the compressor 11 (relationship between the refrigerant flow rate and the operating frequency, high pressure, low pressure and so forth) into a function form or a table form.

Figure 3:
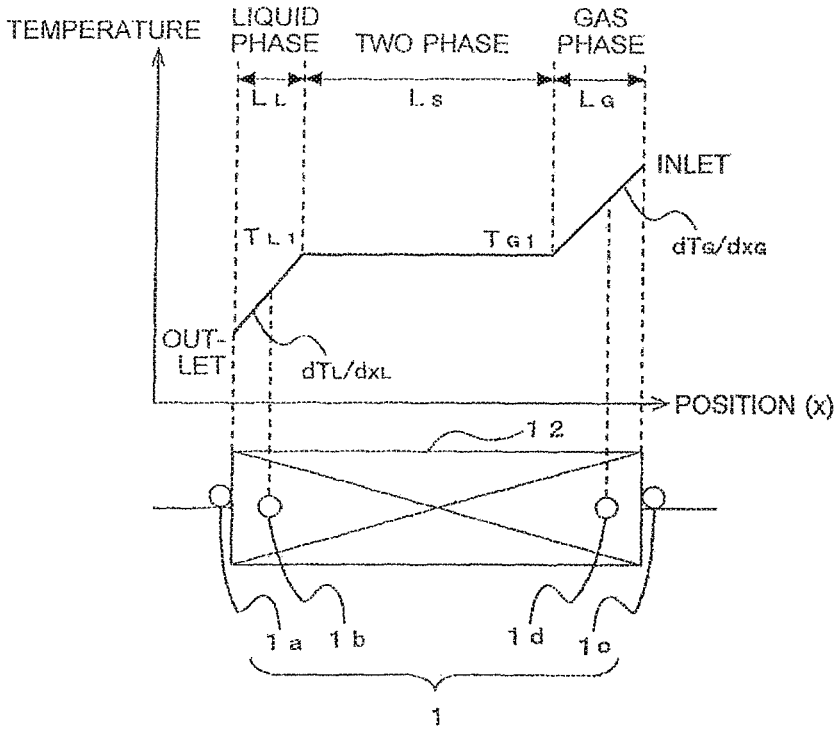
FIG. 3 is a diagram showing variation in refrigerant temperature and disposition of the temperature sensors in a condenser in Embodiment 1 of the present invention.

Next, the calculation method of the volumetric proportions Rcg, Rcs and Rcl of the phases will be described. FIG. 3 is a diagram showing variation in the refrigerant temperature in the condenser 12 and disposition of the temperature sensors 1 in the condenser 12. In FIG. 3, the vertical axis indicates the temperature and the horizontal axis indicates the position. Note that, in this embodiment, description is given by taking a case in which a single refrigerant or azeotropic refrigerant mixture is used. As shown in FIG. 3, a temperature of the refrigerant flowing through the condenser 12 varies in each phase. Specifically, the temperature gradually decreases until reaching the saturated gas temperature $T_{G1}$ in the gas phase part, the temperature is constant and only the state changes in the two-phase gas-liquid part, and the temperature gradually decreases from the saturated liquid temperature $T_{L1}$ in the liquid phase part.

Moreover, as shown in FIG. 3, the first liquid-phase temperature sensor 1*a* is disposed to detect the refrigerant temperature at the outlet of the condenser 12, and the second liquid-phase temperature sensor 1*b* is disposed to detect the refrigerant temperature of the liquid phase part in the condenser 12. Further, the first gas-phase temperature sensor 1*c* is disposed to detect the refrigerant temperature at the inlet of the condenser 12, and the second gas-phase temperature sensor 1*d* is disposed to detect the refrigerant temperature of the gas phase part in the condenser 12. Consequently, the refrigerant amount calculation unit 23 is able to obtain the temperature glide in the direction of refrigerant flow in the liquid phase part ($dT_L/dx_L$) from the detected temperatures and positional information of the first liquid-phase temperature sensor 1*a* and the second liquid-phase temperature sensor 1*b*, and is able to obtain the temperature glide in the direction of refrigerant flow in the gas phase part ($dT_G/dx_G$) from the detected temperatures and positional information of the first gas-phase temperature sensor 1*c* and the second gas-phase temperature sensor 1*d*. Then, by using these temperature glides and the saturated temperatures ($T_{L1}$ and $T_{G1}$), the length and the volumetric proportion in each phase part in the condenser 12 can be estimated.

Figure 4:
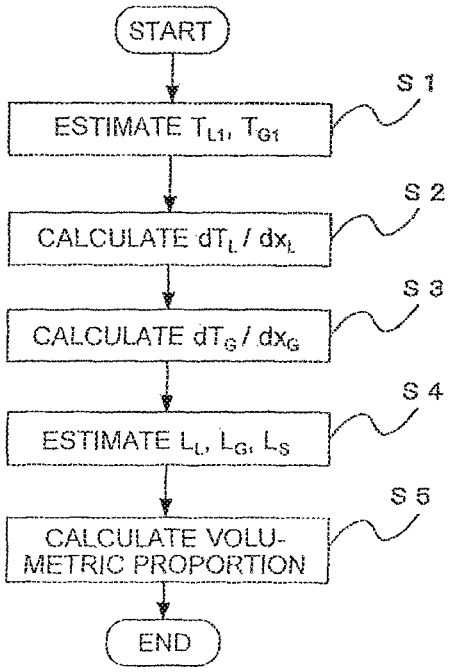
FIG. 4 is a flowchart showing a volumetric proportion calculation process in Embodiment 1 of the present invention.

FIG. 4 is a flowchart showing a volumetric proportion calculation process in this embodiment. The process is started when movement of refrigerant in the refrigerant circuit becomes stable after the operation of the refrigeration cycle apparatus 100 is started. In the process, first, the saturated liquid temperature $T_{L1}$ and the saturated gas temperature $T_{G1}$ in the refrigeration cycle apparatus 100 are estimated (S1). Here, the discharge pressure of the compressor 11 is detected by the discharge pressure sensor 16, and the saturated liquid temperature $T_{L1}$ and the saturated gas temperature $T_{G1}$ are estimated by use of the detected discharge pressure (that is, the condensing pressure) and known refrigerant physical property information. When the refrigerant is a single refrigerant or an azeotropic refrigerant mixture, the saturated liquid temperature $T_{L1}$ is equal to the saturated gas temperature $T_{G1}$. Note that, instead of providing the discharge pressure sensor 16, it may be possible to provide a temperature sensor at the two phase part of the condenser 12 to directly measure the condensing temperature. In this case, the measured condensing temperature serves as the saturated liquid temperature $T_{L1}$ and the saturated gas temperature $T_{G1}$.

Subsequently, the temperature glide $dT_L/dx_L$ in the liquid phase part is calculated (S2). Here, $dT_L$ is a difference between detected temperatures of the first liquid-phase temperature sensor 1*a* and the second liquid-phase temperature sensor 1*b*, and dxL is a distance between the first liquid-phase temperature sensor 1*a* and the second liquid-phase temperature sensor 1*b*. The distance is obtained from the positional information of the first liquid-phase temperature sensor 1*a* and the second liquid-phase temperature sensor 1*b* stored in the memory unit 22. Next, the temperature glide $dT_G/dx_G$ in the gas phase part is calculated (S3). Here, $dT_G$ is a difference between detected temperatures of the first gas-phase temperature sensor 1*c* and the second gas-phase temperature sensor 1*d*, and $dx_G$ is a distance between the first gas-phase temperature sensor 1*c* and the second gas-phase temperature sensor 1*d*. The distance is obtained from the positional information of the first gas-phase temperature sensor 1*c* and the second gas-phase temperature sensor 1*d* stored in the memory unit 22.

Subsequently, from the saturated liquid temperature $T_{L1}$ and the saturated gas temperature $T_{G1}$ estimated in S1 and the temperature glides $dT_L/dx_L$ and $dT_G/dx_G$ that are estimated in S2 and S3, each of the length $L_L$ of the liquid phase part, the length $L_S$ of the two phase part and the length $L_G$ of the gas phase part is estimated (S4). Specifically, a start position of the liquid phase part can be obtained by obtaining a position where an extended line of the temperature glide $dT_L/dx_L$ in the liquid phase part and the saturated liquid temperature $T_{L1}$ intersect with each other. From the relationship between the start position of the liquid phase part and an outlet position of the condenser 12, the length $L_L$ of the liquid phase part is estimated. Similarly, an end position of the gas phase part is obtained by obtaining a position where an extended line of the temperature glide $dT_G/dx_G$ in the gas phase part and the saturated gas temperature $T_{G1}$ intersect with each other. From the relationship between the end position of the gas phase part and an inlet position of the condenser 12, the length $L_G$ of the gas phase part is estimated. Further, by assuming that a part between the liquid phase part and the gas phase part is the two phase part, the length $L_S$ of the two phase part is obtained. Then, from the length of each part, the volumetric proportion of each phase is obtained (S5). Specifically, when the condenser 12 is a circular pipe and has a constant cross section, proportions of length of the phase parts to the known length of the condenser 12 are the volumetric proportions Rcg, Rcs and Rcl of the respective phases.

Then, the average refrigerant density ρc of the condenser 12 is obtained by substituting the volumetric proportions Rcg, Rcs and Rcl of the phases obtained by the volumetric proportion calculation process and the average refrigerant densities ρcg, ρcs and ρcl into Expression (3). From the average refrigerant density ρc and the known volumetric capacity Vc of the condenser 12, the refrigerant amount Mr,c of the condenser 12 is calculated. Further, by calculating the refrigerant amounts in the evaporator 14 and the connection pipe 15 by a known method and adding the refrigerant amounts in the parts together, the refrigerant amount in the refrigerant circuit of the refrigeration cycle apparatus 100 can be estimated.

As described above, in this embodiment, the volumetric proportion of each phase of the condenser 12 can be directly obtained from the detected temperatures and positional information of the multiple temperature sensors 1 disposed in the direction in which the refrigerant flows in the condenser 12. Therefore, it is possible to perform highly accurate estimation of the refrigerant amount without conducting error regulation by coefficients or the like.

Embodiment 2

Subsequently, Embodiment 2 according to the present invention will be described. Embodiment 2 is different from Embodiment 1 in the disposition of the temperature sensors 1 in a condenser 12A and the volumetric proportion calculation process. The configuration of the refrigeration cycle apparatus 100 other than these is similar to Embodiment 1.

Figure 5:
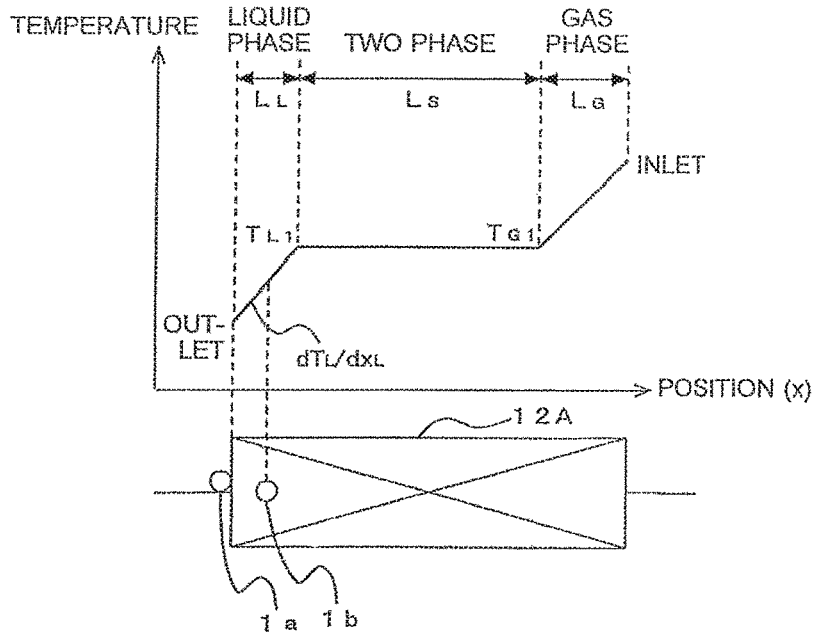
FIG. 5 is a diagram showing variation in refrigerant temperature and disposition of the temperature sensors in a condenser in Embodiment 2 of the present invention.

FIG. 5 is a diagram showing variation in the refrigerant temperature and disposition of the temperature sensors 1 in the condenser 12A of this embodiment. Here, in Embodiment 1, the configuration was employed in which the volumetric proportion in each of the liquid phase, the two phase and the gas phase was calculated; however, since the density of the gas phase is smaller than the density of the liquid phase, if the gas phase is assumed to be the two phase and a configuration to calculate the refrigerant amounts in the liquid phase and the two phase is employed, the error remains small. Therefore, in this embodiment, a configuration is employed in which only the first liquid-phase temperature sensor 1*a* that detects the outlet temperature of the condenser 12A and the second liquid-phase temperature sensor 1*b* that detects the refrigerant temperature of the liquid phase part in the condenser 12A are provided to directly obtain only the length $L_L$ of the liquid phase part.

In this case, the refrigerant amount calculation unit 23 estimates the length $L_L$ of the liquid phase part from the temperature glide $dT_L/dx_L$ in the liquid phase part and the saturated liquid temperature $T_{L1}$, and estimates the remaining length as the length $L_S$ of the two phase part, to calculate the volumetric proportion and the refrigerant amount. In a general refrigeration cycle apparatus, the first liquid-phase temperature sensor 1*a* that detects the outlet temperature of the condenser 12A is normally provided in many cases. Therefore, by employing the configuration as in this embodiment, the volumetric proportion calculation process can be performed by only adding the second liquid-phase temperature sensor 1*b*. Consequently, in addition to the effects of Embodiment 1, Embodiment 2 ensures the reduction of the number of parts and product costs.

Embodiment 3

Subsequently, Embodiment 3 according to the present invention will be described. In the above-described Embodiment 1 and Embodiment 2, descriptions were given by taking the case in which the single refrigerant and the azeotropic refrigerant mixture are used; however, Embodiment 3 is applied to a case in which zeotropic refrigerant is used as the refrigerant. This embodiment is different from Embodiment 1 in the disposition of the temperature sensors 2 in a condenser 12B and the volumetric proportion calculation process. The configuration of the refrigeration cycle apparatus 100 other than these is similar to Embodiment 1.

Figure 6:
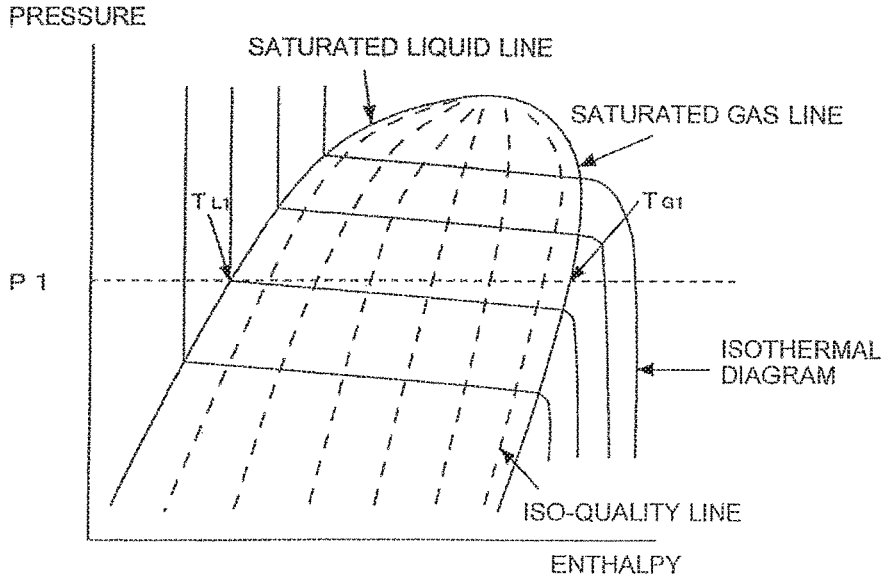
FIG. 6 is a p-h diagram in a case of zeotropic refrigerant mixture.

FIG. 6 is a p-h diagram in the case where the zeotropic refrigerant mixture is used. The zeotropic refrigerant mixture is a mixture of two or more refrigerants having different boiling points. As shown in FIG. 6, in the case of using the zeotropic refrigerant mixture, the saturated liquid temperature $T_{L1}$ at the pressure P1 is not equal to the saturated gas temperature $T_{G1}$, and the saturated gas temperature $T_{G1}$ becomes higher than the saturated liquid temperature $L_{L1}$. Therefore, an isotherm in the two-phase gas-liquid part of the p-h diagram is inclined.

Figure 7:
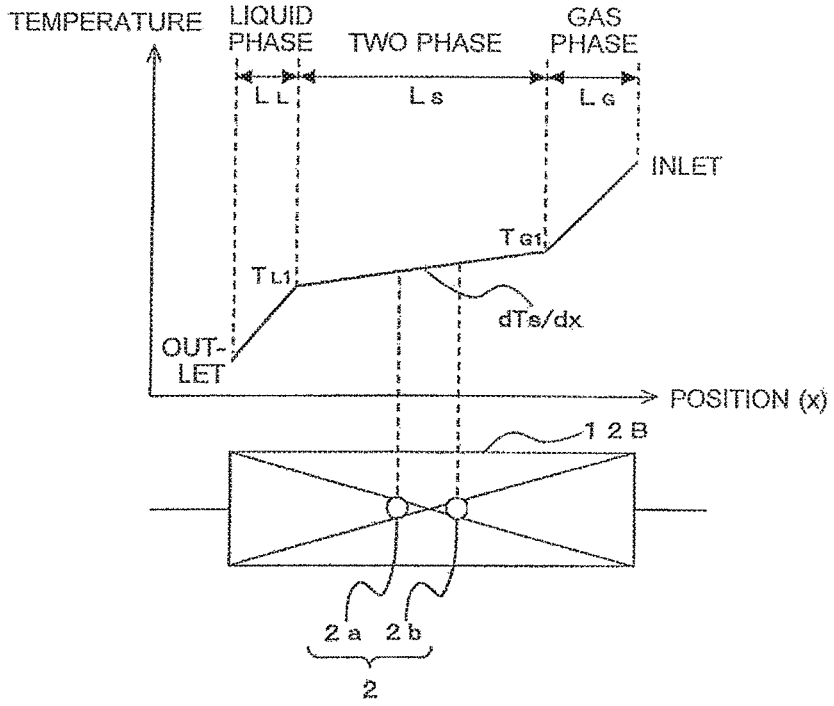
FIG. 7 is a diagram showing variation in refrigerant temperature and disposition of the temperature sensors in a condenser in Embodiment 3 of the present invention.

FIG. 7 is a diagram showing variation in the refrigerant temperature and disposition of the temperature sensors 2 in the condenser 12B of this embodiment. In FIG. 7, the horizontal axis indicates the position and the vertical axis indicates the temperature. As shown in FIG. 7, when the zeotropic refrigerant mixture is used, the refrigerant temperature in the two phase part linearly decreases in the direction of refrigerant flow similar to those in the gas phase part and the liquid phase part. Consequently, from the position of the refrigerant in the flowing direction and the temperature thereof, the state of the refrigerant (enthalpy and quality) in the two phase part can be estimated.

Therefore, the temperature sensors 2 disposed in the condenser 12B include a first two-phase temperature sensor 2*a* and a second two-phase temperature sensor 2*b* that detect the temperatures of the two phase part in the condenser 12B. The first two-phase temperature sensor 2*a* and the second two-phase temperature sensor 2*b* are disposed in line in the direction of refrigerant flow at the center portion of the condenser 12B. Consequently, the refrigerant amount calculation unit 23 is able to obtain the temperature glide in the direction of refrigerant flow in the two phase part ($dT_S/dx$) from the detected temperatures and positional information of the first two-phase temperature sensor 2*a* and the second two-phase temperature sensor 2*b*. Then, by using the temperature glide and the saturated temperatures ($T_{L1}$ and $T_{G1}$), the length and the volumetric proportion in each phase part can be estimated.

Here, by changing the ratio of the mixed components (mixed refrigerants) of the zeotropic refrigerant mixture, the p-h diagram becomes a different one and the temperature glide of the two phase part is changed. Therefore, the distance between the first two-phase temperature sensor 2*a* and the second two-phase temperature sensor 2*b* is set so that a sufficient temperature glide ($dT_S/dx$) corresponding to (the temperature glide of) the used refrigerant can be obtained. Specifically, for example, when the temperature glide of the used refrigerant is small, as compared to the case of the large temperature glide, the distance between the first two-phase temperature sensor 2*a* and the second two-phase temperature sensor 2*b* is set longer.

Figure 8:
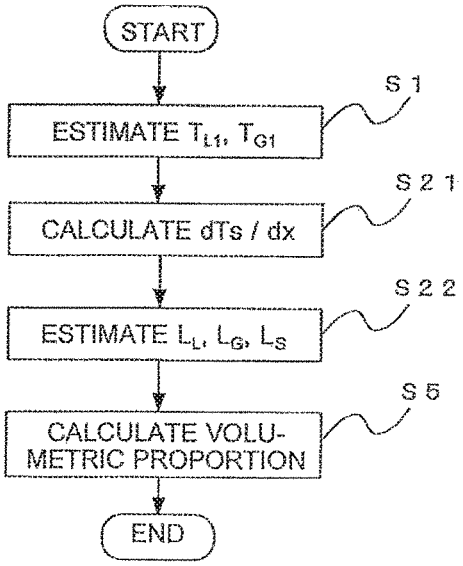
FIG. 8 is a flowchart showing a volumetric proportion calculation process in Embodiment 3 of the present invention.

FIG. 8 is a flowchart showing a volumetric proportion calculation process in this embodiment. Note that, in FIG. 8, processes similar to those in Embodiment 1 are assigned with the same reference signs as those in FIG. 4. In the process, first, the saturated liquid temperature $T_{L1}$ and the saturated gas temperature $T_{G1}$ are estimated from the detected discharge pressure detected by the discharge pressure sensor 16 and known refrigerant physical property information (S1). In this embodiment, since the zeotropic refrigerant is used, the saturated liquid temperature $T_{L1}$ is not equal to the saturated gas temperature $T_{G1}$, and the relationship $T_{L1}<T_{G1}$ holds true. Next, the temperature glide $dT_S/dx$ in the two phase part is calculated (S21). Here, $dT_S$ is a difference between detected temperatures of the first two-phase temperature sensor 2*a* and the second two-phase temperature sensor 2*b*, and dx is a distance between the first two-phase temperature sensor 2*a* and the second two-phase temperature sensor 2*b*. The distance is obtained from the positional information of the first two-phase temperature sensor 2*a* and the second two-phase temperature sensor 2*b* stored in the memory unit 22.

Subsequently, from the saturated liquid temperature $T_{L1}$ and the saturated gas temperature $T_{G1}$ estimated in S1 and the temperature glide $dT_S/dx$ calculated in S21, each of the length $L_L$ of the liquid phase part, the length $L_S$ of the two phase part and the length $L_G$ of the gas phase part is estimated (S22). Specifically, an end position of the two phase part is obtained by obtaining a position where an extended line of the temperature glide $dT_S/dx$ and the saturated liquid temperature $T_{L1}$ intersect with each other. From the relationship between the end position of the two phase part and an outlet position of the condenser 12, the length $L_L$ of the liquid phase part is estimated. Moreover, similarly, the length $L_G$ of the gas phase part is estimated from the temperature glide $dT_S/dx$ and the saturated gas temperature $T_{G1}$. Specifically, a start position of the two phase part is obtained from a position where an extended line of the temperature glide $dT_S/dx$ and the saturated gas temperature $T_{G1}$ intersect with each other. From the relationship between the start position of the two phase part and an inlet position of the condenser 12, the length $L_G$ of the gas phase part is estimated. Further, by assuming that a part between the liquid phase part and the gas phase part is the two phase part, the length $L_S$ of the two phase part is estimated.

Then, similar to Embodiment 1, from the length of each part, the volumetric proportion of each phase is calculated (S5). Then, from the volumetric proportions and the average refrigerant densities of the liquid phase, the two phase and the gas phase, the refrigerant amount of the condenser 12B is calculated.

In this manner, in this embodiment, the length of each phase part can be estimated based on the temperature glide of the two phase part in the zeotropic refrigerant mixture. Since the range of the two phase part is relatively wide in the condenser 12B, there is a high degree of freedom in disposing the first two-phase temperature sensor 2*a* and the second two-phase temperature sensor 2*b*; therefore, it is possible to estimate the length of each phase part more reliably. Particularly, even in a condition of less subcooling, it is possible to estimate the length of each phase part accurately.

Moreover, when the zeotropic refrigerant mixture is used as in this embodiment, it is possible to estimate a quality distribution of the refrigerant in the two phase part from the position in the flow direction and the temperature of the refrigerant. Then, from the quality distribution, it is possible to calculate the two-phase average refrigerant density ρcs in each quality section by using the above-described expression (6). This makes it possible to increase the accuracy in density estimation.

Embodiment 4

Subsequently, Embodiment 4 according to the present invention will be described. Embodiment 4 is different from Embodiment 3 in the point that a correction in consideration of pressure loss in the two phase part is performed in the volumetric proportion calculation process. The configuration of the refrigeration cycle apparatus 100 other than this is similar to Embodiment 3.

Figure 9:
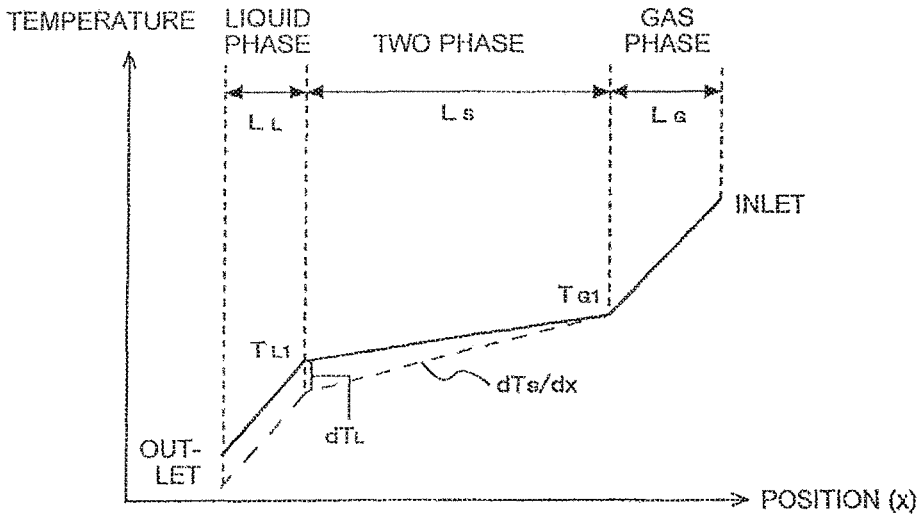
FIG. 9 is a diagram for illustrating pressure loss correction in Embodiment 4 of the present invention.

FIG. 9 is a diagram for illustrating pressure loss correction in this embodiment. In FIG. 9, temperature changes in the condenser 12B without any pressure loss are indicated by a solid line, and an example of temperature changes when pressure loss occurs is indicated by a broken line. As shown in FIG. 9, when pressure loss in the condenser 12B occurs, the temperature of the downstream side in the condenser 12B is lower than the case without any pressure loss. Therefore, there is a need to correct the refrigerant temperature from the physical property value in consideration of the pressure loss.

For instance, in the example shown in FIG. 9, the temperature drop due to the pressure loss is $dT_L$. The $dT_L$ is assumed to be the correction amount of the saturated liquid temperature $T_{L1}$. Then, by subtracting the $dT_L$ from the saturated liquid temperature $T_{L1}$ corresponding to an inlet pressure of the condenser 12B, the correct saturated liquid temperature $T_{L1}$ can be estimated. As a result, the temperature glide $dT_S/dx$ in consideration of the pressure loss can be calculated, and thereby, it becomes possible to estimate the refrigerant amount with high accuracy.

Here, it is possible to estimate the correction amount $dT_L$ by studying correlation between the refrigerant flow rate flowing through the condenser 12B and the $dT_L$ in advance and formulating the correlation into a table form or a function form. The estimated $dT_L$ is stored in the memory unit 22, and is retrieved when the volumetric proportion calculation process is performed. Note that the refrigerant flow rate can be estimated by formulating the properties of the compressor 11 (relationship between the refrigerant flow rate and the operating frequency, high pressure, low pressure and so forth) into a function form or a table form.

Embodiment 5

Subsequently, Embodiment 5 according to the present invention will be described. Embodiment 5 is different from Embodiment 1 in the disposition of the temperature sensors 3 in a condenser 12C and the volumetric proportion calculation process. The configuration of the refrigeration cycle apparatus 100 other than these is similar to Embodiment 1.

Figure 10:
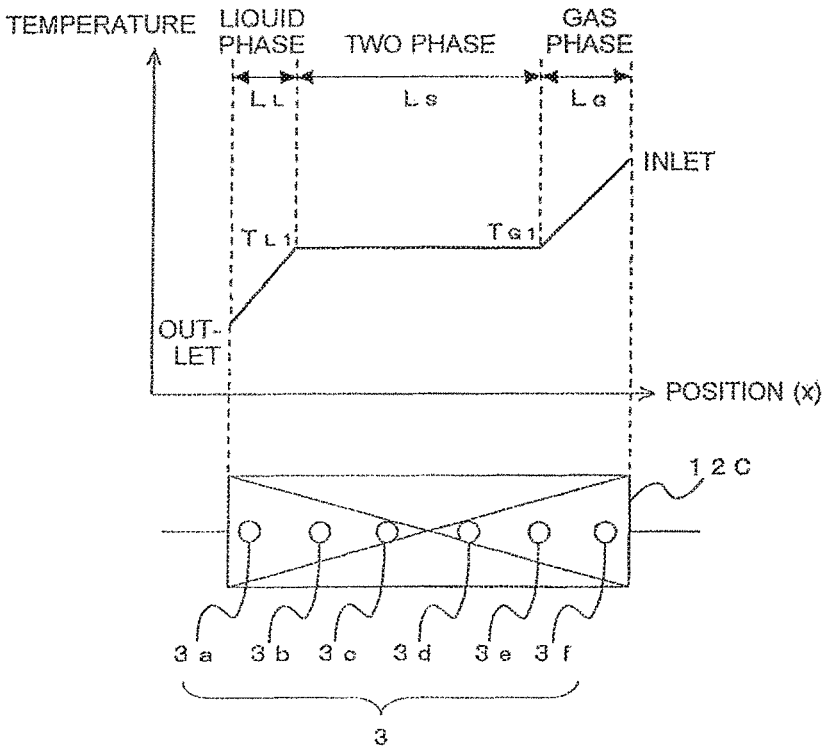
FIG. 10 is a diagram showing variation in refrigerant temperature and disposition of the temperature sensors in a condenser in Embodiment 5 of the present invention.

FIG. 10 is a diagram showing variation in the refrigerant temperature and disposition of the temperature sensors 3 in the condenser 12C of this embodiment. As shown in FIG. 10, the temperature sensors 3 of this embodiment include temperature sensors 3*a*, 3*b*, 3*c*, 3*d*, 3*e* and 3*f*. The temperature sensors 3*a*, 3*b*, 3*c*, 3*d*, 3*e* and 3*f* are disposed in line along a direction in which the refrigerant flows in the condenser 12C. The refrigerant amount calculation unit 23 of this embodiment estimates a temperature distribution in the condenser 12 from the detected temperatures of the multiple temperature sensors 3*a*, 3*b*, 3*c*, 3*d*, 3*e* and 3*f* disposed in the direction in which the refrigerant flows, and calculates the volumetric proportion in each phase from the temperature distribution.

Figure 11:
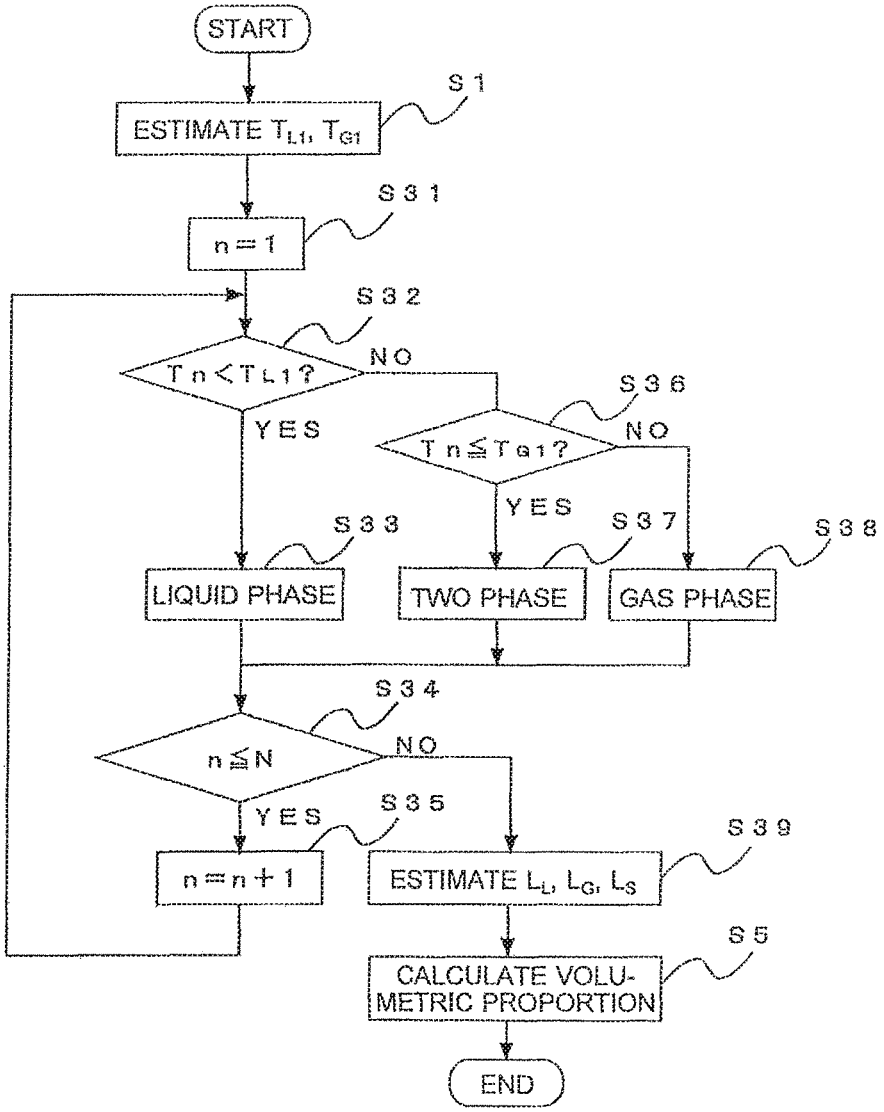
FIG. 11 is a flowchart showing a volumetric proportion calculation process in Embodiment 5 of the present invention.

FIG. 11 is a flowchart showing a volumetric proportion calculation process in this embodiment. Note that, in FIG. 11, processes similar to those in Embodiment 1 are assigned with the same reference signs as those in FIG. 4. In the process, first, the saturated liquid temperature $T_{L1}$ and the saturated gas temperature $T_{G1}$ are estimated from the detected discharge pressure detected by the discharge pressure sensor 16 and known refrigerant physical property information (S1). Next, 1 is set to a variable n (S31). Here, n is a variable for identifying the temperature sensors 3.

Then, it is determined whether or not the detected temperature Tn is lower than the saturated liquid temperature $T_{L1}$ (S32). Here, it is assumed that the temperature detected by the temperature sensor 3*a* is T1, the temperature detected by the temperature sensor 3*b* is T2, and in the same manner, the temperatures detected by the temperature sensors 3*c* to 3*f* are T3 to T6, respectively. Then, in S32, when n=1, it is determined whether or not the temperature T1 detected by the temperature sensor 3*a* is lower than the saturated liquid temperature $T_{L1}$. When the detected temperature Tn is lower than the saturated liquid temperature $T_{L1}$ (S32: YES), it is determined that the temperature sensor corresponding to the detected temperature Tn (for example, the temperature sensor 3*a* when the detected temperature is T1) is disposed in the liquid phase part (S33).

Then, it is determined whether or not n is not more than N (S34). N refers to the number of temperature sensors, and N is 6 in the case of this embodiment. When n is not more than N (S34: YES), 1 is added to n (S35), and the process returns to S32. Then, in S32, when the detected temperature Tn is not less than the saturated liquid temperature $T_{L1}$ (S32: NO), it is determined whether or not the detected temperature Tn is not more than the saturated gas temperature $T_{G1}$ (S36). When the detected temperature Tn is not more than the saturated gas temperature $T_{G1}$ (S36: YES), it is determined that the temperature sensor corresponding to the detected temperature Tn (for example, the temperature sensor 3*c* when the detected temperature is T3) is disposed in the two phase part (S37).

On the other hand, when the detected temperature Tn is more than the saturated gas temperature $T_{G1}$ (S36: NO), it is determined that the temperature sensor corresponding to the detected temperature Tn (for example, the temperature sensor 3*e* when the detected temperature is T5) is disposed in the gas phase part (S38). Then, when it is determined in S34 that n is larger than N (S34: NO), based on the determination results in S33, S37 and S38, each of the length $L_L$ of the liquid phase part, the length $L_S$ of the two phase part and the length $L_G$ of the gas phase part is estimated (S39). Specifically, for example, when it is determined that the temperature sensor 3*a* is disposed in the liquid phase and the temperature sensor 3*b* is disposed in the two phase, it is assumed that the liquid phase part exists between the outlet of the condenser 12C and the temperature sensor 3*b*, and the length $L_L$ of the liquid phase part is estimated based on the positional information of the temperature sensor 3*b*. Similarly, when it is determined that the temperature sensor 3*d* is disposed in the two phase part and the temperature sensor 3*e* is disposed in the gas phase part, it is assumed that the two phase part exists between the temperature sensor 3*b* and the temperature sensor 3*e*, and the length $L_S$ of the two phase part is estimated based on the positional information of the temperature sensor 3*e*. Then, from the length of each part, the volumetric proportion of each phase is obtained (S5).

Then, from the volumetric proportions and the average refrigerant densities of the liquid phase, the two phase and the gas phase, the refrigerant amount of the condenser 12C is calculated.

In this manner, also in this embodiment, effects similar to those in Embodiment 1 can be obtained. Note that, in this embodiment, the configuration was employed in which six temperature sensors 3 were disposed in the condenser 12C; however, it may be possible to employ a configuration in which the temperature sensors 3 not less than seven or not more than five are disposed in the condenser 12C. Moreover, in the example in FIG. 10, the configuration was employed in which the temperature sensors 3*a* to 3*f* were disposed at regular intervals; however, this embodiment is not limited thereto. For example, to estimate the length $L_L$ of the liquid phase part with high accuracy, it may be possible to dispose many temperature sensors 3 in the liquid phase part of the condenser 12 (that is, in the vicinity of the outlet) and reduce the number of temperature sensors 3 near the center portion of the condenser 12.

The embodiments of the present invention have been described above; however, the present invention is not limited to the configurations of the above-described embodiments, and various modifications or combinations within the scope of the technical idea of the present invention are available. For example, in the embodiments, as shown in FIG. 1, the description is given of the case in which the refrigeration cycle apparatus 100 includes a single compressor 11, a single condenser 12 and a single evaporator 14; however, the number of these components is not particularly limited. For example, two or more compressors 11, condensers 12 and evaporators 14 may be provided. Moreover, in the above-described embodiments, the description was given by taking the case in which the refrigeration cycle apparatus 100 is an air-conditioning apparatus used for cooling indoors; however, the present invention is not limited thereto, and may be applied to an air-conditioning apparatus used for heating indoors or an air-conditioning apparatus that can be switched between the cooling/heating modes. Moreover, the present invention may be applied to a small-sized refrigeration cycle apparatus, such as a home-use refrigerator, or a large-sized refrigeration cycle apparatus, such as a refrigerating machine for cooling a refrigerated warehouse or a heat pump chiller.

Moreover, in the above-described Embodiments 3 and 5, the configuration was employed in which the volumetric proportion in each of the liquid phase, the two phase and the gas phase was obtained; however, similar to Embodiment 2, it may be possible to employ the configuration in which the gas phase is assumed to be the two phase and the volumetric proportions of the liquid phase and the two phase are calculated. With the configuration like this, it is possible to reduce the number of temperature sensors to further reduce the costs. Moreover, in the above-described Embodiments 1, 2 and 5, description was given by taking the cases in which a single refrigerant or an azeotropic refrigerant mixture is used as examples; however, the present invention can be similarly applied to a case in which a zeotropic refrigerant mixture is used.

Moreover, the calculation method of the refrigerant amount is not limited to those described in the above embodiments. For example, the volumetric capacity of each phase can be obtained from the length of each phase and the known specifications of the condenser 12. For example, when the condenser 12 is a circular pipe, the following holds true: cross-sectional area in pipe×length of each phase part=volumetric capacity of each phase. Then, the refrigerant amount of each phase can be calculated by multiplying the volumetric capacity of each phase by the average refrigerant density.

Figure 12:
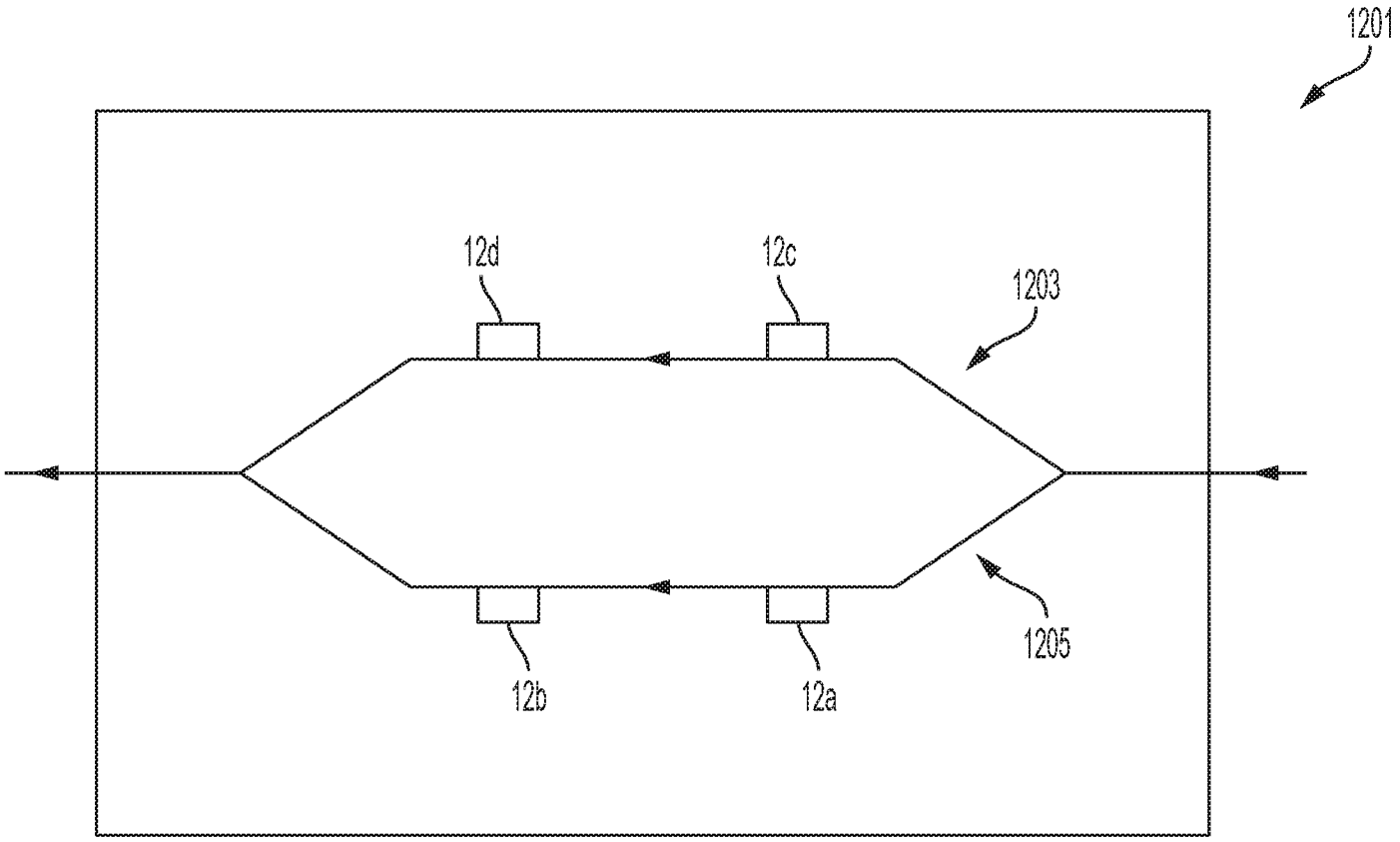
FIG. 12 is a diagram illustrating a condenser employing a pipe configuration with a plurality of branches with temperatures sensors on one or more of the branches.

Further, in the above-described embodiments, description was given by taking a case of the pipe configuration with no branches or merges inside the condenser 12 as an example; however, the present invention can be applied, as seen in FIG. 12, to a condenser 1201 employing a pipe configuration that branches 1205, 1203 at the inlet or at some midpoint and merges at some midpoint or at the outlet. Moreover, the number of branches may be two or more. In this case, the temperature sensors 12*a*, 12*b* and 12*c*, 12*d* are disposed along the direction in which the refrigerant flows in each of the branched routes 1205, 1203, and the length of each phase part (the liquid phase part, the two-phase gas-liquid part and the gas phase part) is obtained as described in the above embodiments in each of the branched routes 1205, 1203. Then, from the length of each phase part, the refrigerant amount is calculated in each of the branched routes 1205, 1203, and, by adding these refrigerant amounts, the refrigerant amount of the condenser 1201 is calculated. This makes it possible to calculate the refrigerant amount with higher accuracy.

Moreover, it may be possible to assume any one of the branched routes 1205, 1203 as a representative route and provide the temperature sensors 12*a*, 12*b* or 12*c*, 12*d* only to the representative route, to obtain the length of each phase part in the representative route. Then, it is possible to assume the length of each phase part in the other branched routes to be similar to the length of each phase part in the representative route, to thereby calculate the refrigerant amount in each of the branched routes 1205, 1203. This makes it possible to reduce the number of temperature sensors, and to reduce the number of parts and the product cost.

The invention claimed is:

1. A refrigeration cycle apparatus comprising:

a refrigerant circuit including a condenser;

a plurality of temperature sensors each disposed in line in a direction in which refrigerant flows in the condenser and configured to detect refrigerant temperature of the condenser;

a memory configured to store positional information of the plurality of temperature sensors; and a processor configured to calculate a refrigerant amount of the condenser based on a distance between two of the plurality of temperature sensors based on the positional information of the plurality of temperature sensors, detected temperatures of the plurality of temperature sensors, and a saturated liquid temperature of the refrigerant.

2. The refrigeration cycle apparatus of claim 1, wherein the processor is configured to estimate a length of a liquid phase part in the condenser based on the positional information of the plurality of temperature sensors, the detected temperatures of the plurality of temperature sensors, and the saturated liquid temperature of the refrigerant.

3. The refrigeration cycle apparatus of claim 2, wherein the processor is configured to obtain a volumetric proportion or a volumetric capacity of the liquid phase part in the condenser from the length of the liquid phase part in the condenser, and calculate the refrigerant amount of the condenser from the volumetric proportion or the volumetric capacity and an average refrigerant density of the liquid phase part.

4. The refrigeration cycle apparatus of claim 2, wherein the processor is configured to obtain a temperature glide of the refrigerant in the direction, in which the refrigerant flows, from a distance between two of the plurality of temperature sensors based on the positional information and the detected temperatures of the plurality of temperature sensors, and estimate the length of the liquid phase part from the temperature glide and the saturated liquid temperature.

5. The refrigeration cycle apparatus of claim 4, wherein the plurality of temperature sensors include a first liquid-phase temperature sensor disposed at an outlet of the condenser and configured to detect the refrigerant temperature at the outlet of the condenser and a second liquid-phase temperature sensor disposed upstream of the first liquid-phase temperature sensor and configured to detect the refrigerant temperature of the liquid phase part in the condenser, and the processor is configured to obtain the temperature glide of the refrigerant in the liquid phase part from a distance between the first liquid-phase temperature sensor and the second liquid-phase temperature sensor based on the positional information and the detected temperatures of the first liquid-phase temperature sensor and the second liquid-phase temperature sensor, and estimate the length of the liquid phase part from the temperature glide of the refrigerant in the liquid phase part and the saturated liquid temperature.

6. The refrigeration cycle apparatus of claim 5, wherein the plurality of temperature sensors further include a first gas-phase temperature sensor disposed at an inlet of the condenser and configured to detect the refrigerant temperature at the inlet of the condenser and a second gas-phase temperature sensor disposed downstream of the first gas-phase temperature sensor and configured to detect the refrigerant temperature of a gas phase part in the condenser, the processor is configured to obtain the temperature glide of the refrigerant in the gas phase part from a distance between the first gas-phase temperature sensor and the second gas-phase temperature sensor based on the positional information and the detected temperatures of the first gas-phase temperature sensor and the second gas-phase temperature sensor, and estimate a length of gas phase part of the refrigerant flowing through the condenser from the temperature glide of the refrigerant in the gas phase part and a saturated gas temperature of the refrigerant, and the processor is further configured to estimate a length of a two-phase gas-liquid part of the refrigerant flowing through the condenser from the length of the liquid phase part and the length of the gas phase part.

7. The refrigeration cycle apparatus of claim 4, wherein the refrigerant includes a zeotropic refrigerant mixture, the plurality of temperature sensors include a first two-phase temperature sensor disposed at a center portion of the condenser and configured to detect the refrigerant temperature of a two-phase gas-liquid part in the condenser and a second two-phase temperature sensor disposed upstream of the first two-phase temperature sensor and configured to detect the refrigerant temperature of the two-phase gas-liquid part, and the processor is configured to obtain the temperature glide of the refrigerant in the two-phase gas-liquid part from a distance between the first two-phase temperature sensor and the second two-phase temperature sensor based on the positional information and the detected temperatures of the first two-phase temperature sensor and the second two-phase temperature sensor, and estimate the length of the liquid phase part from the temperature glide of the refrigerant in the two-phase gas-liquid part and the saturated liquid temperature.

8. The refrigeration cycle apparatus of claim 7, wherein the processor is configured to estimate a length of a gas phase part of the refrigerant flowing through the condenser from the temperature glide of the refrigerant in the two-phase gas-liquid part and a saturated gas temperature of the refrigerant.

9. The refrigeration cycle apparatus of claim 7, wherein the processor is configured to obtain a quality distribution in the two-phase gas-liquid part from the detected temperatures of the first two-phase temperature sensor and the second two-phase temperature sensor and the positional information, and calculate an average refrigerant density in the two-phase gas-liquid part based on the quality distribution.

10. The refrigeration cycle apparatus of claim 2, wherein the processor is configured to compare each of the detected temperatures of the plurality of temperature sensors with the saturated liquid temperature of the refrigerant to estimate the length of the liquid phase part.

11. The refrigeration cycle apparatus of claim 2, wherein the condenser includes a plurality of branched routes in each of which the refrigerant flows, the plurality of temperature sensors are disposed in line in the direction in which the refrigerant flows in each of the plurality of branched routes, and the processor is configured to estimate, in each of the plurality of branched routes, the length of the liquid phase part of the refrigerant flowing through the branched route.

12. The refrigeration cycle apparatus of claim 2, wherein the condenser includes a plurality of branched routes in each of which the refrigerant flows, the plurality of temperature sensors are disposed in line in the direction in which the refrigerant flows in one of the plurality of branched routes, and the processor is configured to estimate the length of the liquid phase part of the refrigerant flowing through the one branched route, and estimate the length of the liquid phase part of the refrigerant flowing through each of the other branched routes from the length of the liquid phase part of the refrigerant flowing through the one branched route.

13. The refrigeration cycle apparatus of claim 1, wherein the memory is further configured to store a correction value that corrects temperature drop due to pressure loss in the condenser, and the processor is configured to correct the saturated liquid temperature by using the correction value stored in the memory.

14. The refrigeration cycle apparatus of claim 1, further comprising:

a discharge pressure sensor configured to detect a discharge pressure of a compressor in the refrigerant circuit, wherein the saturated liquid temperature is estimated from the discharge pressure.

* * * * *